US007496300B2

(12) United States Patent
Dan

(10) Patent No.: US 7,496,300 B2
(45) Date of Patent: Feb. 24, 2009

(54) IMAGE-FORMING DEVICE

(75) Inventor: Kenichi Dan, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 517 days.

(21) Appl. No.: 11/197,948

(22) Filed: Aug. 4, 2005

(65) Prior Publication Data

US 2006/0029402 A1 Feb. 9, 2006

(30) Foreign Application Priority Data

Aug. 4, 2004 (JP) ..... 2004-228235

(51) Int. Cl.
*G03G 15/00* (2006.01)

(52) U.S. Cl. ..... 399/21; 399/18

(58) Field of Classification Search ..... 399/21, 399/18

See application file for complete search history.

(56) References Cited

U.S. PATENT DOCUMENTS

| | | | | | |
|---|---|---|---|---|---|
| 5,404,200 | A | * | 4/1995 | Martin et al. | 399/68 |
| 5,957,446 | A | | 9/1999 | Takanuma | |
| 6,006,012 | A | * | 12/1999 | Shimizu | 358/1.14 |
| 6,008,879 | A | * | 12/1999 | Masutani | 355/40 |
| 6,011,936 | A | * | 1/2000 | Kaneko | 399/21 |
| 6,081,341 | A | * | 6/2000 | Kim | 358/1.14 |
| 6,430,377 | B1 | * | 8/2002 | Tsutsumi | 399/19 |

FOREIGN PATENT DOCUMENTS

| | | | |
|---|---|---|---|
| JP | 6-127747 | A | 5/1994 |
| JP | 6-191107 | A | 7/1994 |
| JP | 8-143181 | A | 6/1996 |
| JP | 8-286586 | A | 11/1996 |
| JP | 9-183537 | A | 7/1997 |
| JP | 10-90963 | A | 4/1998 |
| JP | 2000-122361 | A | 4/2000 |
| JP | 2001-158538 | A | 6/2001 |
| JP | 2001-312150 | A | 11/2001 |
| JP | 2003-128319 | A | 5/2003 |

OTHER PUBLICATIONS

Patent Abstracts of Japan for JP8-286586 published Nov. 1, 1996.
Patent Abstracts of Japan for JP2001-312150 published Nov. 9, 2001.
Patent Abstracts of Japan for JP6-191107 published Jul. 12, 1994.

(Continued)

*Primary Examiner*—Anthony H. Nguyen
(74) *Attorney, Agent, or Firm*—Darby & Darby P.C.

(57) ABSTRACT

When a laser printer is turned on or awakened from a sleep state and detects a sheet of paper on the paper conveying path, the laser printer performs a process to display a paper jam error upon determining that the sheet of paper should be removed. However, if the laser printer determines based on the detection results from a trailing edge sensor that the sheet of paper was inserted through a manual feed opening, the laser printer determines that the paper need not be removed and, hence, does not perform the process to display a paper jam error.

19 Claims, 6 Drawing Sheets

OTHER PUBLICATIONS

Patent Abstracts of Japan for JP2001-158538 published Jun. 12, 2001.

Patent Abstracts of Japan for JP9-183537 published Jul. 15, 1997.

Patent Abstracts of Japan for JP6-127747 published May 10, 1994.

Patent Abstracts of Japan for JP8-143181 published Jun. 4, 1996.

Patent Abstracts of Japan for JP2000-122361 published Apr. 28, 2000.

Patent Abstracts of Japan for JP2003-128319 published May 8, 2003.

Patent Abstracts of Japan for JP10-90963 published Apr. 10, 1998.

* cited by examiner

IMAGE-FORMING DEVICE

BACKGROUND OF THE INVENTION

1. Field of the Invention

The present invention relates to an image-forming device for forming images on a recording medium.

2. Description of the Related Art

An image-forming device for forming images on a recording medium, such as a paper, accommodated in a paper tray while the recording medium is conveyed from the paper tray along a conveying path is well known in the art. One such image-forming device disclosed in Japanese Patent Application Publication No. HEI-8-286586, upon detecting the presence of a recording medium on the conveying path in the device during an initialization process for shifting the device into a standby state in which the device can form images on a recording medium, discharges the detected recording medium from the device concurrently with the initialization process.

Another image-forming device well known in the art has a manual printing capability that allows a user to manually insert the recording medium into the middle of the conveying path via a paper tray so as not to apply a bending force to recording media that creases easily, such as post cards or other thick paper. Specifically, this type of image-forming device can be configured with a special feeding roller that is driven to introduce the recording medium onto the conveying path when the recording medium has been loaded into a manual feed tray, as described in Japanese unexamined patent application publication No. HEI-8-286586, or can be configured with a manual feeding slot through which the recording medium can be directly inserted onto the conveying path, as described in Japanese unexamined patent application publication No. 2000-122361.

However, a problem arises with the latter configuration disclosed in Japanese unexamined patent application publication No. 2000-122361 when applying a process such as that described in Japanese unexamined patent application publication No. HEI-8-286586 to discharge a recording medium from the conveying path out of the device. Specifically, there is a danger that the recording medium will be discharged from the device even when the recording medium has been properly inserted through the manual feeding slot.

SUMMARY

In view of the foregoing, it is an object of the present invention to provide an image-forming device that has a manual feeding slot through which a recording medium may be directly inserted onto the conveying path, and that does not remove the recording medium from the conveying path when the recording medium has been properly inserted through the manual feeding slot.

The above and other objects will be obtained by an image-forming device that includes an image-forming unit for forming an image on a recording medium (a paper or other sheet-like recording medium); a recording medium accommodating unit for accommodating a recording medium to be supplied to the image-forming unit; a detecting unit for detecting the existence of a recording medium on a conveying path along which the recording medium is conveyed from the recording medium accommodating unit to the image-forming unit; and removing unit for determining whether there exists a recording medium on the conveying path that should be removed from the conveying path based on the results of detections by the detecting unit when the image-forming unit is not performing an operation for forming images on a recording medium (image-forming operation), and performs a recording medium removal process for removing the recording medium from the conveying path upon determining the existence of a recording medium to be removed from the conveying path. The image-forming device also includes a manual feeding slot through which a recording medium can be directly inserted onto the conveying path.

With this construction, the removing unit determines whether the recording medium detected by the detecting unit is a recording medium that has been inserted through the manual feeding slot. When the removing unit determines that the recording medium has been inserted through the manual feeding slot, the removing unit determines that the recording medium need not be removed from the conveying path and, hence, does not perform the recording medium removal process.

In other words, the image-forming device performs the recording medium removal process for removing a recording medium from the conveying path after determining that a recording medium to be removed exists on the recording path while an image-forming operation is not being performed on the recording medium. However, the image-forming device does not perform the recording medium removal process when it is determined that the recording medium detected on the recording path has been inserted through the manual feeding slot and, therefore, need not be removed.

Hence, the image-forming device having this construction can avoid performing the recording medium removal process for all detected recording media, even a recording medium that has been inserted through the manual feeding slot. The periods or timings at which the recording medium removal process is performed may be set as described below.

For example, in an image-forming device according to another aspect of the present invention, the removing unit performs the recording medium removal process upon determining the existence of a recording medium to be removed from the conveying path based on the results of a detection performed by the detecting unit when the power of the image-forming device is turned on. The determination is made based on detection results when the power is turned on because it is conceivable that a recording medium may be present on the conveying path at such a time if for some reason the power to the image-forming device was turned off during an image-forming operation, for example. Hence, the image-forming device having this construction can perform the recording medium removal process efficiently.

In an image-forming device according to another aspect of the present invention, the removing unit performs the recording medium removal process upon determining the existence of a recording medium to be removed from the conveying path based on the results of detections by the detecting unit performed when the image-forming device is awakened from a sleep state. The sleep state is a state that consumes less power than the normal state and is entered from the normal state when a prescribed condition is met, such as when the image-forming device has not been operated continuously for a prescribed time. The determination is made based on detection results at this time in consideration for cases in which a recording medium was inserted through the manual feeding slot while the image-forming device was in the sleep state, resulting in the existence of a recording medium to be removed from the conveying path when the image-forming device is awakened from the sleep state. Hence, the image-forming device having this construction can perform the recording medium removal process efficiently.

An image-forming device according to another aspect of the present invention further includes a plurality of rollers including a recording medium supply roller for supplying the recording medium accommodated in the recording medium accommodating unit onto the conveying path; a rotational driving force generating unit for generating a common rotational driving force for rotating the plurality of rollers; and a transmission state switching unit for switching between a transmission state that transfers the rotational driving force generated by the rotational driving force generating unit to the recording medium supply rollers and a non-transmission state for not transferring this rotational driving force. The removing unit performs the recording medium removal process upon determining the presence of a recording medium to be removed from the conveying path based on detection results obtained by the detecting unit during an initialization operation for setting the state of the transmission state switching unit to the non-transmission state and directing the rotational driving force generating unit to generate a rotational driving force. The determination is performed based on detection results during the initialization operation in consideration for cases in which the state of the transmission state switching unit is set to the transmission state for some reason during the initialization operation, causing the recording medium accommodated in the recording medium accommodating unit to be supplied onto the conveying path by the recording medium supply rollers and thereby producing a recording medium to be removed from the conveying path, and cases in which the recording medium is inserted through the manual feeding slot during the initialization operation. Hence, the image-forming device having this construction can perform the recording medium removal process efficiently.

More specific examples of the recording medium removal process for removing recording media from the conveying path are given below.

For example, in an image-forming device according to another aspect of the present invention, the removing unit performs a process to convey and discharge the recording medium to be removed from the conveying path as the recording medium removal process. The image-forming device having this construction can remove the recording medium without inconveniencing the operator.

An image-forming device according to another aspect of the present invention further includes a reporting unit for performing a reporting operation, such as displaying a text message or graphics or outputting a beep or other sound. The removing unit executes a process using the reporting unit to prompt the user to remove the recording medium from the conveying path. The image-forming device having this construction ensures the reliable removal of a recording medium that has become jammed in the recording path and cannot be conveyed.

Various techniques may be used to determine whether the recording medium detected by the detecting unit is inserted through the manual feeding slot, including a method of storing a history of detection results for detections performed by the detecting unit and making the determination based on this history (for example, when a recording medium to be removed from the conveying path is present at the time the image-forming device is turned on), and a method of making the determination based on a user-performed operation. However, the following configuration is preferable.

Specifically, in an image-forming device according to another aspect of the present invention, the detecting unit has a dedicated sensor for detecting only one of a recording medium supplied through the manual feeding slot and a recording medium supplied from the recording medium accommodating unit. The removing unit determines whether the recording medium detected by the detecting unit has been inserted through the manual feeding slot based on the results of detections by the dedicated sensor.

For example, if the dedicated sensor functions to detect a recording medium supplied from the recording medium accommodating unit at a position on the conveying path upstream of a position for inserting a recording medium through the manual feeding slot, i.e., the dedicated sensor does not detect a recording medium supplied through the manual feeding slot, then the removing unit determines that the recording medium detected by the dedicated sensor is not a recording medium that has been inserted through the manual feeding slot.

By providing a dedicated sensor in this way to detect only one of a recording medium inserted through the manual feeding slot and a recording medium supplied from the recording medium accommodating unit, it is possible to determine with a simple construction whether the recording medium detected by the detecting unit has been inserted through the manual feeding slot.

In an image-forming device according to another aspect of the present invention, a pair of registration rollers for correcting an oblique orientation of the recording medium is provided on the conveying path downstream of the position for inserting the recording medium through the manual feeding slot. In addition to the dedicated sensor for detecting a recording medium supplied from the recording medium accommodating unit at a position on the conveying path upstream of the position for inserting the recording medium through the manual feeding slot, the detecting unit also includes a pre-registration sensor for detecting the existence of a recording medium on the upstream side of the registration rollers in order to gauge a timing at which the registration rollers correct an oblique orientation of the recording medium, and a timing sensor for detecting the existence of a recording medium on the upstream side of the image-forming unit in order to gauge a timing at which the image-forming unit begins image formation.

Further, the removing unit determines whether to perform the recording medium removal process as described below in rules (1)-(4) based on detection results from the dedicated sensor, the pre-registration sensor, and the timing sensor.

(1) The removing unit determines that a recording medium detected by the timing sensor should be removed from the conveying path and performs the recording medium removal process.

(2) The removing unit determines that a recording medium detected by both the pre-registration sensor and the dedicated sensor should be removed from the conveying path and performs the recording medium removal process.

(3) The removing unit determines that a recording medium detected by only the pre-registration sensor and a recording medium detected by only the dedicated sensor should not be removed from the conveying path and does not perform the recording medium removal process.

(4) The removing unit does not perform the recording medium removal process when a recording medium has not been detected by any sensor.

Hence, when a recording medium is present on the conveying path but can undergo image formation properly from that state, the image-forming device does not perform the recording medium removal process on that recording medium.

For example, if a recording medium has already been detected by the timing sensor, this recording medium is targeted for the recording medium removal process since it is not possible to accurately gauge the timing at which the image-forming unit should begin image formation (rule (1) described above).

If a recording medium has been detected by both the pre-registration sensor and the dedicated sensor, this recording medium is targeted for the recording medium removal process because the recording medium was supplied from the recording medium accommodating unit and, even though an image-forming operation is not being performed, is likely present on the conveying path due to some abnormality (rule (2) described above).

However, if only the dedicated sensor has detected a recording medium, then that recording medium is not targeted for the recording medium removal process. Although the recording medium has been supplied from the recording medium accommodating unit and likely exists on the conveying path due to some abnormality, because an image-forming operation is not being performed, the recording medium has only been conveyed a short distance from the recording medium accommodating unit. Hence, there is a high likelihood that the recording medium can undergo a proper image-forming operation from this state (rule (3) described above).

If only the pre-registration sensor has detected a recording medium, then the removing unit determines that the recording medium has been properly inserted through the manual feeding slot and does not target the recording medium for a recording medium removal process (rule (3) described above).

If no sensor has detected a recording medium, then obviously the removing unit does not perform the recording medium removal process because a recording medium to be removed from the conveying path does not exist (rule (4) described above).

In an image-forming device according to another aspect of the present invention, the dedicated sensor for detecting the recording medium supplied from the recording medium accommodating unit at a position on the conveying path upstream of the position at which the recording medium is inserted through the manual feeding slot detects the recording medium at a position near the recording medium accommodating unit and is used for gauging the timing at which the recording medium accommodated in the recording medium accommodating unit is supplied onto the conveying path. Hence, the image-forming device determines whether a recording medium detected by the detecting unit has been inserted through the manual feeding slot based on results of detections by the dedicated sensor, which is used to gauge the timing at which the recording medium accommodated in the recording medium accommodating unit is supplied onto the conveying path. By appropriating the dedicated sensor in this way, it is possible to reduce the number of required parts and thereby reduce the cost of the image-forming device.

In an image-forming device according to another aspect of the present invention, the detecting unit has another sensor positioned downstream of the dedicated sensor on the conveying path. The removing unit determines that a recording medium should not be removed from the conveying path and does not perform the recording medium removal process if another sensor has not detected the recording medium, even when the dedicated sensor has detected the recording medium. More specifically, a recording medium that has been detected by the dedicated sensor but not by another sensor has been supplied from the recording medium accommodating unit and likely exists on the conveying path due to some abnormality, even though an image-forming operation is not being performed. However, the removing unit does not make this recording medium a target for the recording medium removal process because the recording medium has only been conveyed a short distance from the recording medium accommodating unit and can likely undergo a proper image formation process from this state. Hence, the image-forming device having this construction does not perform the recording medium removal process unnecessarily.

In an image-forming device according to another aspect of the present invention, a pair of registration rollers for correcting an oblique orientation of the recording medium is disposed on the conveying path downstream of the position at which the recording medium is inserted through the manual feeding slot. The rotation of the registration rollers is halted a prescribed time after the dedicated sensor detects the trailing edge of the recording medium. This prescribed time is sufficient to allow the trailing edge of the recording medium to pass through the registration rollers. Hence, the rotation of the registration rollers is halted after the trailing edge of the recording medium conveyed from the recording medium accommodating unit has passed through the registration rollers. This configuration makes it unlikely that a recording medium inserted through the manual feeding slot will be conveyed at the same time as a recording medium conveyed from the recording medium accommodating unit. More specifically, if a recording medium is inserted through the manual feeding slot while another recording medium is being conveyed from the recording medium accommodating unit, the recording medium inserted through the manual feeding slot will be conveyed into the image-forming device by the rotation of the registration rollers. However, since the image-forming device described above halts the rotation of the registration rollers after the trailing edge of the recording medium conveyed from the recording medium accommodating unit has passed through the registration rollers, the recording medium inserted through the manual feeding slot can be separated from the recording medium supplied from the recording medium accommodating unit. In particular, since the image-forming device described above uses a dedicated sensor to detect the recording medium supplied from the recording medium accommodating unit, and not the recording medium inserted through the manual feeding slot, for gauging the timing at which the rotation of the registration rollers is halted, the image-forming device can accurately gauge this timing irregardless the presence of a recording medium inserted through the manual feeding slot.

Here, the timing for halting rotation of the registration rollers must be set so that the trailing edge of the recording medium conveyed from the recording medium accommodating unit has passed through the registration rollers. By setting a longer timing, it is possible to ensure that the trailing edge of the recording medium passes reliably through the registration rollers, but a recording medium inserted through the manual feeding slot at this time will be conveyed for a longer period.

In an image-forming device according to another aspect of the present invention, the detecting unit has a timing sensor for detecting the existence of a recording medium upstream of the image-forming unit in order to gauge the timing at which the image-forming unit begins image formation. The timing for halting rotation of the registration rollers is thus set so that the trailing edge of the recording medium passes through the registration rollers but does not pass the timing sensor. Hence, if a recording medium is inserted through the manual feeding slot immediately after a recording medium is conveyed from the recording medium accommodating unit, the rotation of the registration rollers is halted before the leading edge of the recording medium inserted through the manual feeding slot passes the timing sensor so that this recording medium is not conveyed. This construction reduces the likelihood of a recording medium inserted through the manual feeding slot being conveyed to a position from which image formation cannot be reliably performed (the position detected by the timing sensor).

In an image-forming device according to another aspect of the present invention, the removing unit determines that a recording medium detected by the timing sensor must be removed from the conveying path and performs the recording medium removal process. Specifically, when the timing sensor has already detected a recording medium, it is not possible to accurately gauge the timing at which image formation should begin. Therefore, this recording medium is targeted for the recording medium removal process. Hence, the image-forming device having this construction prevents a recording medium from being left on the conveying path when the recording medium cannot be reliably used for image formation.

In an image-forming device according to another aspect of the present invention, the detecting unit includes a timing sensor for detecting the existence of a recording medium upstream of the image-forming unit in order to gauge the timing at which the image-forming unit begins image formation. The removing unit determines that a recording medium detected by the timing sensor should be removed from the conveying path and performs the recording medium removal process. Specifically, the removing unit targets a recording medium that has already been detected by the timing sensor for the recording medium removal process since the timing for beginning image formation on this recording medium cannot be accurately gauged. Hence, the image-forming device having this construction can prevent a recording medium from being left on the conveying path when image formation cannot be properly performed on the recording medium.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE EMBODIMENTS

An image forming device according to an embodiment of the invention will be described with reference to the accompanying drawings. In the following description, "the terms "upward", downward", "upper", "lower", "above", "below" and the like will be used throughout the description assuming that a laser printer exemplified as the image forming device in the following description is disposed in an orientation in which it is intended to be used. In use, the laser printer is disposed as shown in FIG. 1.

Figure 1:
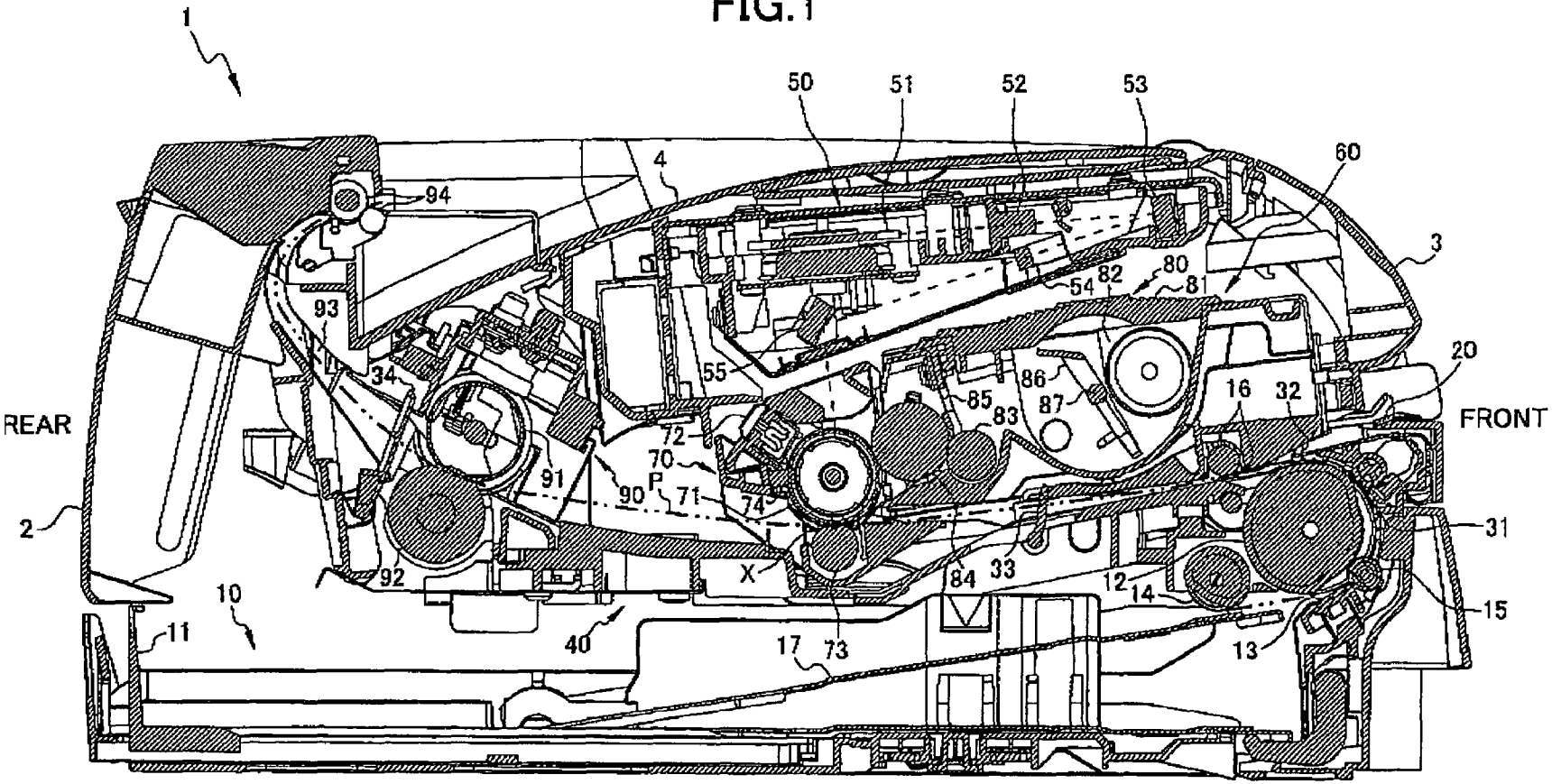
FIG. 1 is a side cross-sectional view of a laser printer according to a preferred embodiment.

FIG. 1 is a side cross-sectional view showing a laser printer 1, serving as the image-forming device of the preferred embodiment.

As shown in FIG. 1, the laser printer 1 has a main casing 2 and, within the main casing 2, a feeder unit 10 for supplying sheets of a paper P, an image-forming unit 40 for forming images on the paper P supplied from the feeder unit 10, and the like. In the following description, the right side of the laser printer 1 in FIG. 1 will be referred to as the front side, and the left side of the laser printer 1 in FIG. 1 will be referred to as the rear side.

A front cover 3 is also provided on the front side of the main casing 2 for opening and closing a mounting opening through which a process cartridge 60 described later is mounted and removed. The front cover 3 is rotatably supported on a cover shaft (not shown) inserted through the bottom end of the front cover 3. Hence, when the front cover 3 is swung closed about the cover shaft, the front cover 3 blocks the mounting opening. When the front cover 3 is swung open about the cover shaft, the mounting opening is revealed, allowing the process cartridge 60 to be mounted in or removed from the main casing 2 via the mounting opening. An operating panel (not shown) is embedded in the top surface of the laser printer 1. The operating panel includes operating keys and a display unit 101 (see FIG. 3).

The feeder unit 10 includes a paper tray (or a recording medium accommodating unit) 11 that is detachably mounted in a bottom section of the main casing 2; a feeding roller (or a recording medium supply roller) 12 and a separating pad 13 disposed above the front end of the paper tray 11; a pickup roller 14 disposed on the rear side of the feeding roller 12; a pinch roller 15 disposed in opposition to the lower front side of the feeding roller 12; and registration rollers 16 disposed above the rear side of the feeding roller 12.

The paper tray 11 accommodates the paper P. A paper pressing plate 17 is provided in the paper tray 11 for supporting a plurality of the paper P in a stacked state. The rear end of the paper pressing plate 17 is pivotably supported so that the front end of the paper pressing plate 17 can move vertically. The paper pressing plate 17 supports the paper P so that the topmost sheet of the paper P is pressed against the pickup roller 14. As the pickup roller 14 rotates, the topmost sheet of paper P is conveyed between the feeding roller 12 and separating pad 13.

As the paper P conveyed by the pickup roller 14 toward the feeding roller 12 and separating pad 13 becomes interposed between the feeding roller 12 and separating pad 13, the rotation of the feeding roller 12 reliably separates and conveys the paper P one sheet at a time. The paper P fed by the feeding roller 12 passes between the feeding roller 12 and the pinch roller 15 and is conveyed to the registration rollers 16.

The registration rollers 16 are configured of a pair of rollers disposed in opposition to each other. After correcting the oblique orientation of the paper P, the registration rollers 16 convey the paper P toward a transfer position X of the image-forming unit 40 (a nip position between a photosensitive drum 71 and a transfer roller 73 described later).

A manual feeding slot or a manual insertion opening 20 is formed above the feeding roller 12 in the front surface of the laser printer 1 for directly feeding the paper P onto a conveying path for the same. Hence, the paper P can be supplied onto the conveying path without loading paper P in the paper tray 11.

The image-forming unit 40 includes a scanning unit 50, the process cartridge 60 mentioned above, and a fixing unit 90.

The scanning unit 50 is disposed in an upper section of the main casing 2 and includes a laser light source (not shown), a polygon mirror 51 that can be driven to rotate, an fθ lens 52, a reflecting mirror 53, a lens 54, and a reflecting mirror 55. The laser light source emits a laser beam based on image data. As indicated by the broken line in FIG. 1, the laser beam is deflected by the polygon mirror 51, transmitted through the fθ lens 52, reflected back by the reflecting mirror 53, transmitted through the lens 54, and bent downward by the reflecting mirror 55. In this way, the laser beam is irradiated onto the surface of the photosensitive drum 71 described later in a high-speed scan.

The process cartridge 60 is disposed below the scanning unit 50 and detachably mounted in the main casing 2. The process cartridge 60 includes a drum cartridge 70, and a developing cartridge 80 that is detachably mounted on the drum cartridge 70.

The drum cartridge 70 includes the photosensitive drum 71, a Scorotron charger 72, the transfer roller 73, and a cleaning brush 74.

The photosensitive drum 71 is configured of a main drum body that is grounded and a surface layer formed of a positive charging photosensitive layer of polycarbonate or the like.

The Scorotron charger 72 is disposed diagonally above and rearward of the photosensitive drum 71, confronting the photosensitive drum 71 but separated a prescribed distance therefrom. The Scorotron charger 72 is a positive charging Scorotron charger having a charging wire formed of tungsten or the like from which a corona discharge is generated. The Scorotron charger 72 functions to charge the entire surface of the photosensitive drum 71 with a uniform positive polarity.

The transfer roller 73 is rotatably supported on the drum cartridge 70 and contacts the photosensitive drum 71 vertically from below so as to form a nip region with the photosensitive drum 71. The transfer roller 73 includes a metal shaft member covered by a roller member that is formed of an electrically conductive rubber material. A transfer bias is applied to the transfer roller 73.

The cleaning brush 74 is disposed on the rear side of the photosensitive drum 71. The cleaning brush 74 has a brush end that is in contact with the surface of the main drum body of the photosensitive drum 71.

The developing cartridge 80 includes a casing 81 and, within the casing 81, a toner accommodating chamber 82, a supply roller 83, a developing roller 84, and a thickness regulating blade 85.

The toner accommodating chamber 82 accommodates a nonmagnetic, single-component toner having a positive charge. The toner used in the preferred embodiment is a polymerized toner obtained by co-polymerizing a polymerized monomer using a well-known polymerization method such as suspension polymerization. The polymerized monomer may be, for example, a styrene monomer such as styrene or an acrylic monomer such as an acrylic acid, alkyl ($C_1$-$C_4$) acrylate, or alkyl ($C_1$-$C_4$) metaacrylate. The polymerized toner is formed as substantially spherical particles having excellent fluidity and being capable of forming images of high quality.

This type of toner is compounded with a coloring agent such as carbon black, or with a wax, as well as an additive such as silica to improve fluidity. The diameter of the toner particles is about 6-10 mm.

The developing cartridge 80 also includes a rotating shaft 87 disposed in the center of the toner accommodating chamber 82 and extending in the widthwise direction, and an agitator 86 that is supported on the rotating shaft 87 inside the toner accommodating chamber 82 and functions to agitate toner within the toner accommodating chamber 32. Hence, the agitator 86 rotates about the rotating shaft 87, stirring the toner in the toner accommodating chamber 82 so that some of the toner is discharged from the rear side of the toner accommodating chamber 82.

The supply roller 83 is disposed at a position rearward of the toner accommodating chamber 82 and can rotate counterclockwise in FIG. 1. The developing roller 84 is disposed against the supply roller 83 and can also rotate counterclockwise in FIG. 1, the same rotational direction as the supply roller 83. The supply roller 83 and developing roller 84 contact each other with a degree of pressure.

The supply roller 83 is configured of a metal shaft member covered by a roller member that is formed of an electrically conductive foam material. The developing roller 84 is configured of a metal shaft member covered by a roller member that is formed of an electrically conductive rubber material. More specifically, the roller member of the developing roller 84 is formed of an electrically conductive urethane rubber or silicon rubber including fine carbon particles or the like, the surface of which rubber is coated with a urethane rubber or silicon rubber including fluorine.

The thickness regulating blade 85 is configured of a main blade member formed of a metal leaf spring member, and a pressing part provided on the free end of the main blade member. The pressing part has a semicircular cross-section and is formed of an insulating silicon rubber. The thickness regulating blade 85 is supported in the developing cartridge 80 near the developing roller 84 so that the elastic force of the main blade member causes the pressing part to contact the surface of the developing roller 84 with pressure.

Toner discharged from the toner accommodating chamber 82 by the rotation of the agitator 86 is supplied onto the developing roller 84 by the rotation of the supply roller 83. At this time, the toner is positively tribocharged between the supply roller 83 and developing roller 84. As the developing roller 84 rotates, the toner supplied onto the surface of the developing roller 84 passes between the developing roller 84 and the pressing part of the thickness regulating blade 85, at which time the toner is further tribocharged and smoothed so that a thin layer of uniform thickness is carried on the developing roller 84.

After the Scorotron charger 72 has formed a uniform positive charge on the surface of the photosensitive drum 71, the scanning unit 50 irradiates a laser beam onto the surface of the photosensitive drum 71 in a high-speed scan in order to form an electrostatic latent image on the photosensitive drum 71 based on prescribed image data.

Next, the positively charged toner carried on the surface of the developing roller 84 is brought into contact with the photosensitive drum 71 as the developing roller 84 rotates. At this time, the latent image formed on the surface of the photosensitive drum 71 is developed into a visible image when the toner is selectively attracted to portions of the photosensitive drum 71 that were exposed to the laser beam and, therefore, have a lower potential than the rest of the surface having a uniform positive charge. In this way, a toner image is formed through a reverse developing process.

Subsequently, the photosensitive drum 71 and transfer roller 73 are driven to rotate so that a paper P is interposed between the photosensitive drum 71 and transfer roller 73 and conveyed by the same. The toner image carried on the surface of the photosensitive drum 71 is transferred onto the paper P as the paper P is conveyed between the photosensitive drum 71 and transfer roller 73.

During the transfer process, paper dust from the paper P is deposited on the surface of the photosensitive drum 71 through contact with the paper P. As the photosensitive drum 71 continues to rotate, the cleaning brush 74 contacting the surface of the photosensitive drum 71 removes this paper dust therefrom.

The fixing unit 90 is disposed rearward of the process cartridge 60 and includes a heating roller 91 and a pressure roller 92.

The heating roller 91 is configured of a metal cylinder, and a halogen lamp accommodated in the metal cylinder for generating heat. A main motor 111 (see FIG. 3) inputs a motive force to drive the heating roller 91 to rotate.

The pressure roller 92 is disposed below the heating roller 91 and contacts the heating roller 91 with pressure. The pressure roller 92 is configured of a metal shaft member covered by a roller that is formed of a rubber material. The pressure roller 92 follows the rotation of the heating roller 91.

After toner has been transferred onto the paper P, the toner is fixed to the paper P by heat in the fixing unit 90 as the paper P passes between the heating roller 91 and pressure roller 92. Subsequently, the paper P is conveyed along a discharge path 93 that runs vertically upward toward the top surface of the main casing 2. A pair of discharge rollers 94 disposed on the top end of the discharge path 93 receives the paper P conveyed along the discharge path 93 and discharges the paper P onto a discharge tray 4 formed on the top surface of the main casing 2.

Figure 2:
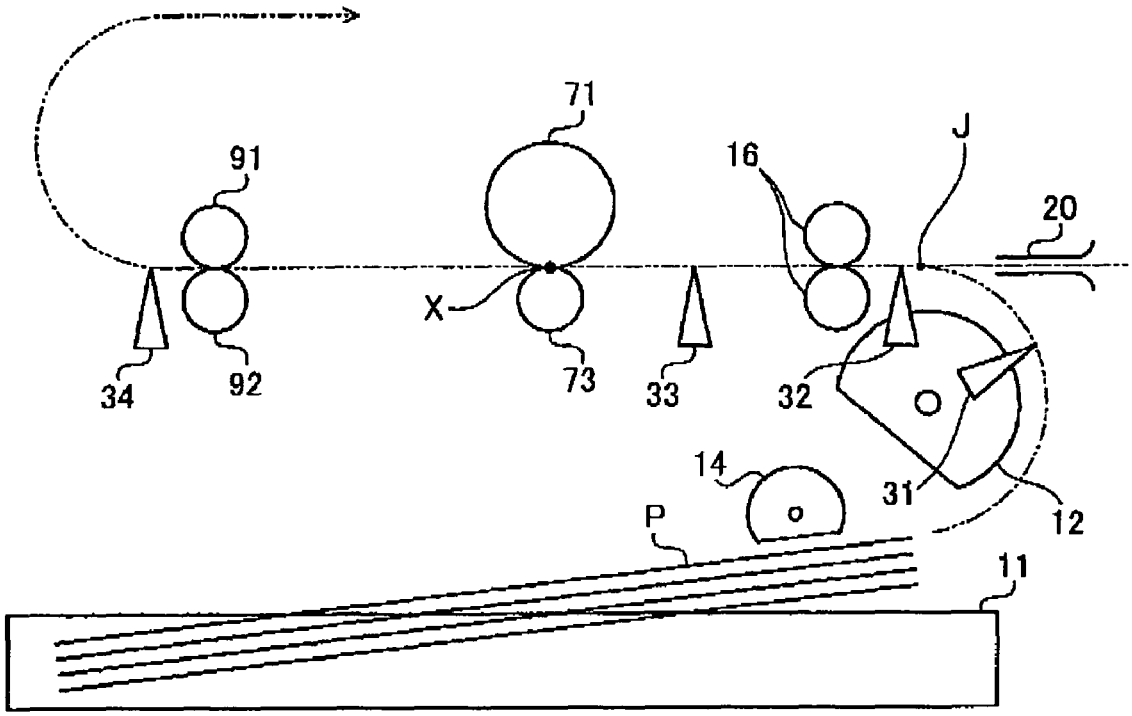
FIG. 2 is an explanatory diagram illustrating positions of sensors in the laser printer.

Next, sensors disposed along the conveying path of the laser printer 1 for detecting the paper P will be described. FIG. 2 is an explanatory diagram showing the placement of the sensors in the laser printer 1.

As shown in FIG. 2, sensors for detecting the presence of the paper P are provided along the conveying path indicated by a broken line. These sensors include a trailing edge sensor (or a dedicated sensor) 31, a pre-registration sensor 32, a post-registration sensor (or a timing senor) 33, and a discharge sensor 34.

The sensors 31-34 used in the laser printer 1 of the preferred embodiment detect the paper P mechanically. Each sensor has a detecting member that is pivotably supported and that is directly pushed by the paper P as the paper P is conveyed along the conveying path. The sensor is turned on when the leading edge of the paper P passes the position of the sensor and remains on as long as the paper P is present. The sensor turns off after the trailing edge of the paper P has passed the position of the sensor.

The trailing edge sensor 31 is disposed upstream of an insertion position J with respect to the conveying direction. The insertion position J is the position at which the paper P is manually introduced onto the conveying path through the manual feeding slot 20. Accordingly, the trailing edge sensor 31 does not detect the paper P introduced via the manual feeding slot 20, but only detects the paper P fed from the paper tray 11. Among the sensors 31-34, the trailing edge sensor 31 is disposed nearest the paper tray 11 and is used for gauging a timing for supplying paper P accommodated in the paper tray 11 onto the conveying path. More specifically, when a plurality of sheets of paper P accommodated in the paper tray 11 are consecutively printed in the laser printer 1 of the preferred embodiment, the trailing edge sensor 31 detects the trailing edge of the paper P being conveyed by the feeding roller 12, so that an operation to feed the next sheet of paper P can be started based on this detection timing. By using the trailing edge sensor 31 disposed nearest the paper tray 11 to control the paper feeding timing, it is possible to reduce the distance between sheets of the paper P that are fed consecutively.

The pre-registration sensor 32 is disposed downstream of the insertion position J and upstream of the registration rollers 16 with respect to the conveying direction. The pre-registration sensor 32 is used for gauging a timing at which the registration rollers 16 correct the oblique orientation of the paper P. More specifically, the registration rollers 16 are temporarily halted in the laser printer 1 when the pre-registration sensor 32 detects the leading edge of the paper P. After the leading edge of the paper P contacts the registration rollers 16 and the paper P begins to bend, the registration rollers 16 are once again driven to correct the orientation of the paper P.

The post-registration sensor 33 is disposed downstream of the registration rollers 16 and upstream of the transfer position X for the image-forming unit 40 with respect to the conveying direction. The post-registration sensor 33 is used to gauge a timing at which the image-forming unit 40 should begin image formation. More specifically, the post-registration sensor 33 detects the leading edge of the paper P conveyed from the registration rollers 16, and the timing at which the image-forming unit 40 begins forming an image on the paper P is gauged based on this detection timing, thereby accurately positioning the image on the paper P.

The discharge sensor 34 is disposed downstream of the heating roller 91 with respect to the conveying direction.

The laser printer 1 of the preferred embodiment is configured so that a user may insert a paper P through the manual feeding slot 20 until the paper P contacts the registration rollers 16. Although the pre-registration sensor 32 detects the presence of the paper P at this time, the laser printer 1 performs an operation to wait while the leading edge of the paper P is interposed between the registration rollers 16 (hereinafter referred to as a manual intake operation). More specifically, the rotation of the registration rollers 16 is temporarily halted when the pre-registration sensor 32 detects the paper P. Subsequently, the registration rollers 16 are rotated for a short prescribed time T1 (one second, for example) until the leading edge of the paper P becomes interposed between the registration rollers 16, and then are halted again. In this way, the registration rollers 16 hold the paper P that has been inserted through the manual feeding slot 20 and remain in a wait state for a printing operation.

Figure 3:
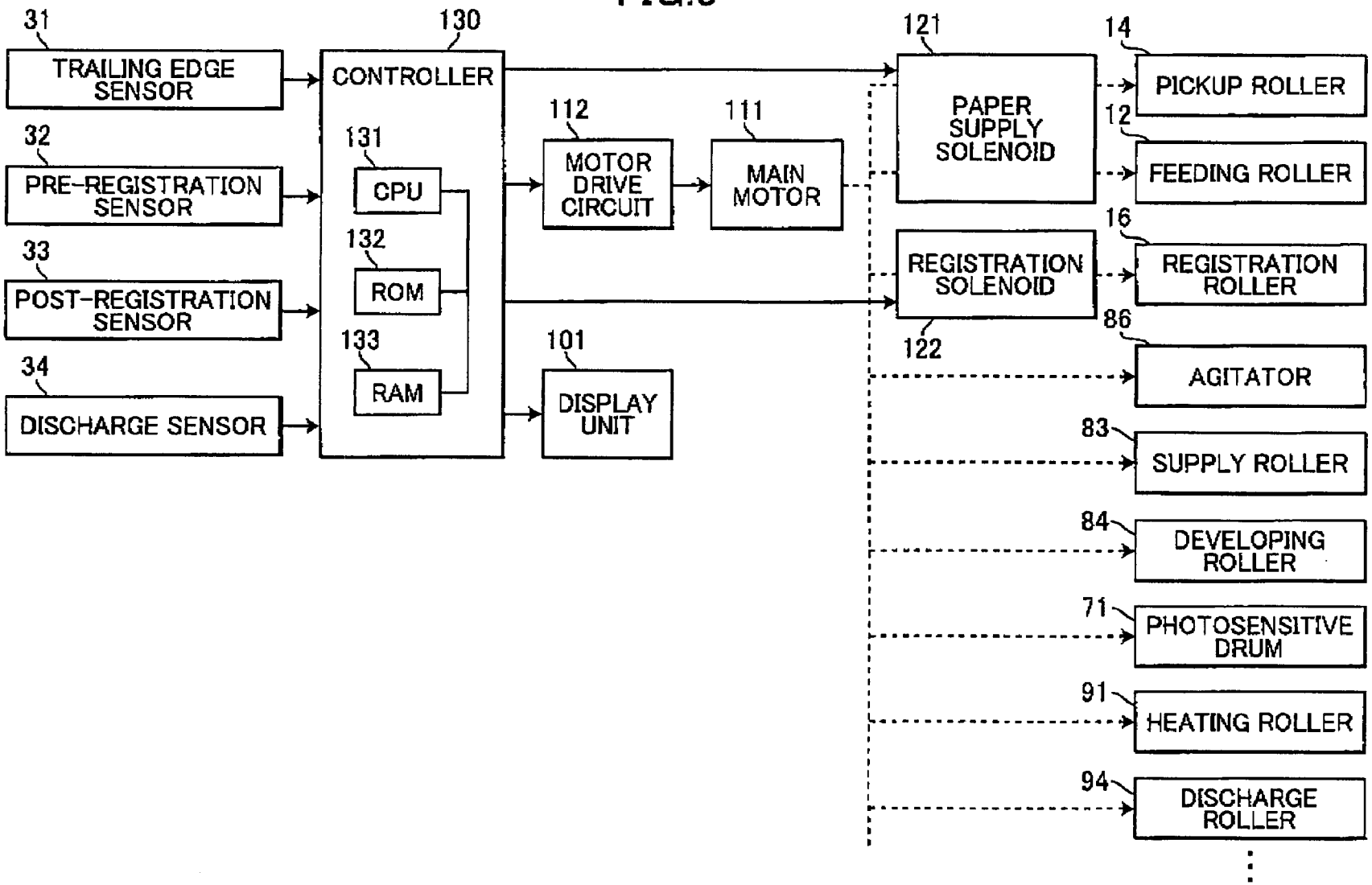
FIG. 3 is a block diagram showing the electrical configuration of the laser printer.

Next, the electrical configuration of the laser printer 1 will be described with reference to the block diagram in FIG. 3. As shown in FIG. 3, the laser printer 1 includes the trailing edge sensor 31, pre-registration sensor 32, post-registration sensor 33, and discharge sensor 34 described above. The laser printer 1 is also provided with the display unit 101 for displaying messages and the like to the user, the main motor 111 that generates a common rotational driving force for rotating a plurality of rotating members (rollers and the like) provided in the laser printer 1, a motor drive circuit 112 for driving the main motor 111, a paper supply solenoid 121 disposed on a transmission path for transmitting the rotational driving force from the main motor 111 to the pickup roller 14 and feeding roller 12 (indicated by dotted lines in FIG. 3), a registration solenoid 122 disposed on the transmission path for transmitting the rotational driving force from the main motor 111 to the registration rollers 16, and a controller 130. The controller 130 includes a CPU 131, ROM 132, and RAM 133 well known in the art.

The main motor 111 is a common power source for driving the rotation of the pickup roller 14, feeding roller 12, registration rollers 16, agitator 86, supply roller 83, developing roller 84, photosensitive drum 71, heating roller 91, and discharge rollers 94. Therefore, all of the aforementioned rollers and the like are rotated together by driving the main motor 111.

However, the rotational driving force supplied from the main motor 111 to the pickup roller 14 and feeding roller 12 is transmitted via the paper supply solenoid 121. Further, the rotational driving force supplied from the main motor 111 to the registration rollers 16 is transmitted via the registration solenoid 122. The paper supply solenoid 121 and registration solenoid 122 can be switched between a transmission state for transmitting the rotational driving force generated by the main motor 111 and a non-transmission state for not transmitting this rotational driving force.

Specifically, when the paper supply solenoid 121 is turned off (normal state), the paper supply solenoid 121 is in a non-transmission state, and the rotational driving force is not transmitted from the main motor 111 to the pickup roller 14 and the feeding roller 12. When the paper supply solenoid 121 is turned on, the paper supply solenoid 121 is in a transmission state and the rotational driving force is transmitted from the main motor 111 to the pickup roller 14 and the feeding roller 12. When the paper supply solenoid 121 is turned on one time, the feeding roller 12 rotates one time and feeds one sheet of paper. On the other hand, the registration solenoid 122 is in a transmission state when turned off (normal state), and the rotational driving force is transmitted from the main motor 111 to the registration rollers 16. When the registration solenoid 122 is turned on, the registration solenoid 122 enters the non-transmission state, and the rotational driving force is not transmitted from the main motor 111 to the registration rollers 16.

Before the laser printer 1 performs a printing operation and, more specifically, immediately after the power of the laser printer 1 is turned on or immediately after the laser printer 1 is awakened from a sleep state, the laser printer 1 performs an initialization operation to heat the heating roller 91 and to rotate the main motor 111. The purpose of the initialization operation is to accumulate heat in the heating roller 91 and agitate the toner, among other things. If a printing operation is not performed over a continuous prescribed interval (such as 15 minutes), then the laser printer 1 enters a sleep state, consuming only the minimum power required for resuming when a print request is received. When an operation is performed, the laser printer 1 awakens from the sleep state and returns to the normal state.

Before performing this initialization operation and during the initialization operation, the laser printer 1 determines whether a paper P exists on the conveying path and should be removed. If a paper P is present on the conveying path and must be removed therefrom, the laser printer 1 performs a process to remove the paper P from the conveying path.

Figure 4:
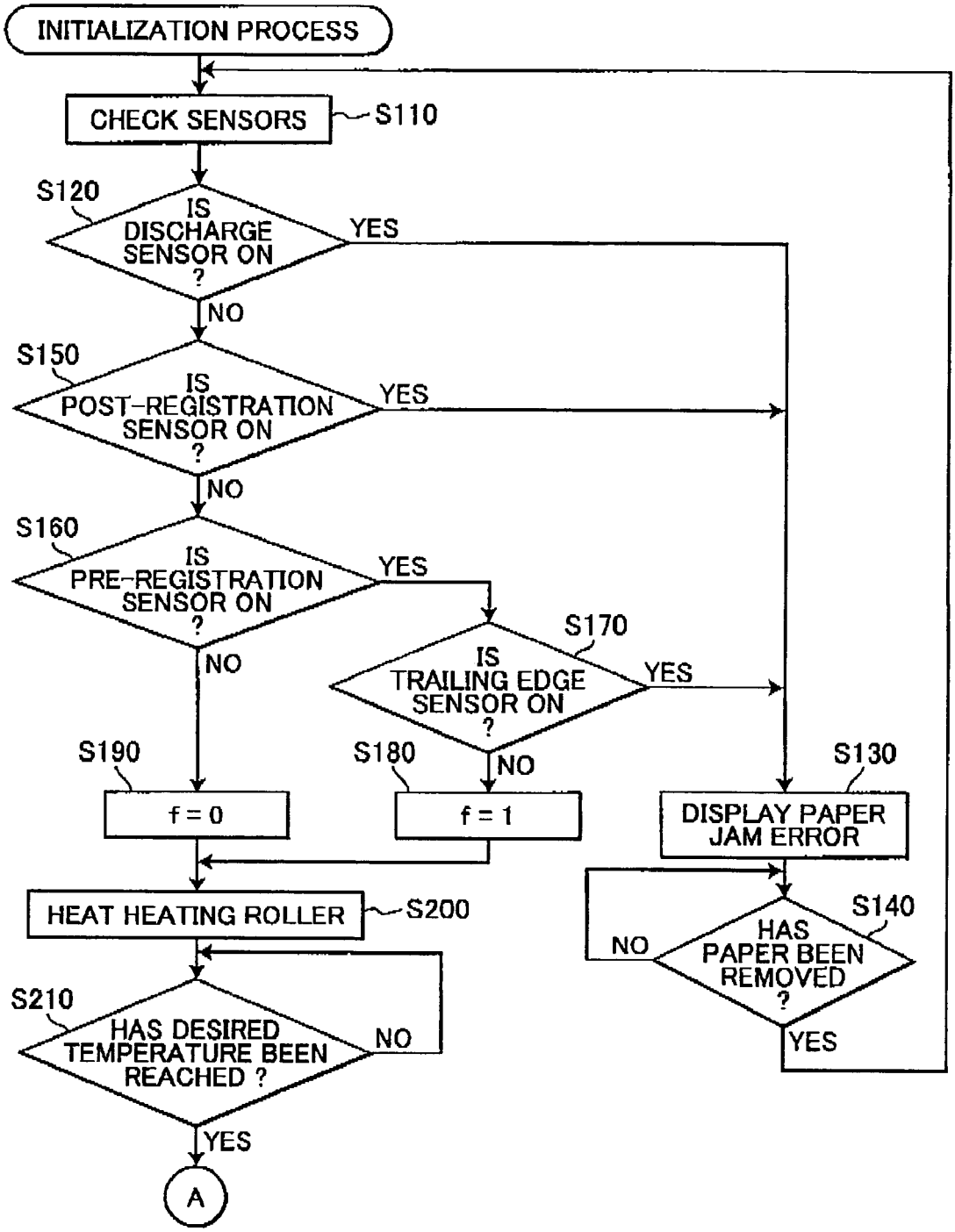
FIG. 4 is a flowchart showing a first part of an initialization process.
Figure 5:
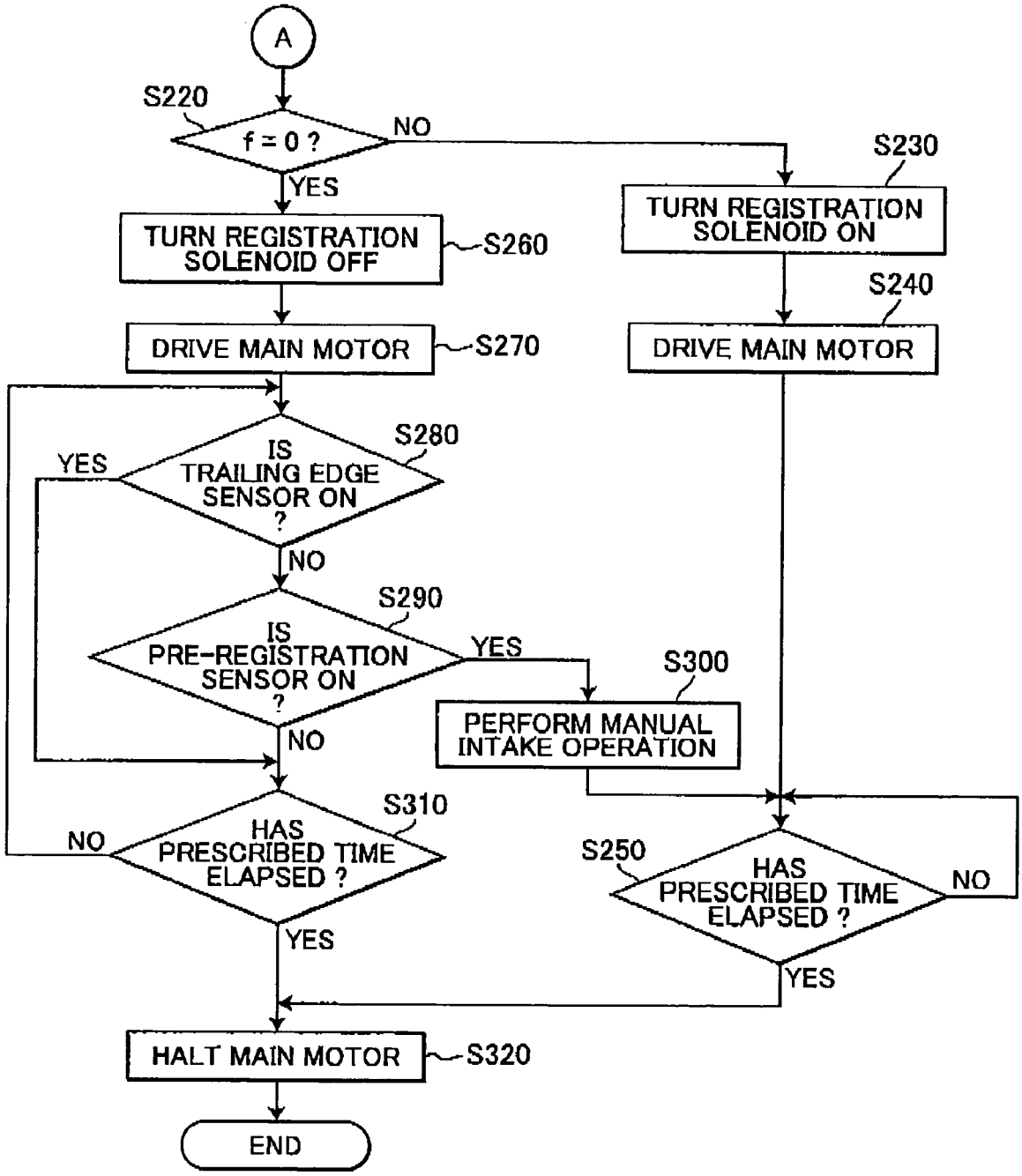
FIG. 5 is a flowchart showing a second part of the initialization process.

Next, the initialization process executed by the CPU 131 in the controller 130 will be described with reference to the flowcharts in FIGS. 4 and 5. The initialization process begins when the power of the laser printer 1 is turned on or when the laser printer 1 awakens from a sleep state.

At the beginning of the initialization process in S110, the CPU 131 checks the detection status of each of the sensors 31-34 to determine whether the paper P has been detected.

In S120 the CPU 131 determines whether the discharge sensor 34 has detected the paper P. If the CPU 131 determines that the discharge sensor 34 has detected the paper P(S120: YES), then in S130 the CPU 131 performs a process to display a message on the display unit 101 notifying the user that a paper jam has occurred. In other words, if the discharge sensor 34 has detected the paper P when the power is turned on or when the laser printer 1 has recovered from a sleep state, the CPU 131 determines that a paper jam has occurred and performs a notification operation to prompt the user to remove the jammed paper P.

In S140 the CPU 131 enters a wait state and remains in this state until the CPU 131 determines that the user has removed the paper P. When the CPU 131 determines that the paper P has been removed (S140: YES), the CPU 131 returns to S110.

However, if the CPU 131 determines that the discharge sensor 34 has not detected the paper P in S120 (S120: NO), then in S150 the CPU 131 determines whether the post-registration sensor 33 has detected the paper P.

If the CPU 131 determines that the post-registration sensor 33 has detected the paper P(S150; YES), then the CPU 131 advances to S130 and performs the process described above. In other words, if the post-registration sensor 33 has detected the paper P when the power is turned on or when the laser printer 1 has recovered from a sleep state, the CPU 131 determines that a paper jam has occurred and performs the notification operation, prompting the user to remove the paper P.

However, if the CPU 131 determines in S150 that the post-registration sensor 33 has not detected the paper P (hence, neither the discharge sensor 34 nor the post-registration sensor 33 has detected the paper P; S150: NO), then in S160 the CPU 131 determines whether the pre-registration sensor 32 has detected the paper P.

If the CPU 131 determines that the pre-registration sensor 32 has detected the paper P(S160: YES), then in S170 the CPU 131 determines whether the trailing edge sensor 31 has detected the paper P.

If the CPU 131 determines that the trailing edge sensor 31 has detected the paper P(S170: YES), then the CPU 131 advances to 5130 and repeats the process described above. In other words, if the paper P has been detected by both the pre-registration sensor 32 and the trailing edge sensor 31 when the power is turned on or when the laser printer 1 has recovered from a sleep state, then the CPU 131 determines that the paper P has not been inserted via the manual feeding slot 20 and that a paper jam has occurred with paper P supplied from the paper tray 11. Accordingly, the CPU 131 performs the notification operation for prompting the user to remove the paper P.

However, if the CPU 131 determines in S170 that the trailing edge sensor 31 has not detected the paper P, then in S180 the CPU 131 sets the value of a flag f representing the presence of the paper P inserted through the manual feeding slot 20 to a "1", indicating that a paper P inserted through the manual feeding slot 20 exists on the conveying path. Subsequently, the CPU 131 advances to S200. In other words, if only the pre-registration sensor 32 has detected the paper P when the power is turned on or when the laser printer 1 has recovered from a sleep state, the CPU 131 determines that the paper P has been properly inserted through the manual feeding slot 20 and need not be removed from the conveying path and, moreover, that a paper jam has not occurred. Accordingly, the CPU 131 does not perform the notification operation in S130 for prompting the user to remove the paper P.

If the CPU 131 determined in S160 that the pre-registration sensor 32 has not detected the paper P (hence, none of the sensors 34, 33, and 32 have detected the paper P), then in S190 the CPU 131 sets the flag f to "0", indicating that a paper P inserted through the manual feeding slot 20 does not exist on the conveying path. Subsequently, the CPU 131 advances to S200. In other words, when the paper P has been detected by only the trailing edge sensor 31 or when the paper P has not been detected by any of the sensors 31-34 when the power is turned on or when the laser printer 1 recovers from a sleep state, then the CPU 131 determines that a paper jam has not occurred and does not perform the notification operation in S130 for prompting the user to remove the paper P. Here, the CPU 131 determines that a paper jam has not occurred when only the trailing edge sensor 31 has detected the paper P because the paper P has only been conveyed a short distance from the paper tray 11 and can likely be used for a normal printing operation from this state.

In S200 the CPU 131 performs a process for initiating a heating operation to heat the heating roller 91 to a prescribed temperature, such as 185° C.

In S210 the CPU 131 waits until the heating roller 91 has reached the prescribed temperature. When the CPU 131 determines that the heating roller 91 has reached the prescribed temperature (S210: YES), then the CPU 131 advances to S220 (see FIG. 5).

In S220 the CPU 131 determines whether the value of the flag f is "0". If the CPU 131 determines that the value of the flag f is not "0" (in other words, the value of the flag f is "1"; S220: NO), then in S230 the CPU 131 performs a process to turn the registration solenoid 122 on (the non-transmission state in which the rotational driving force is not transferred from the main motor 111 to the registration rollers 16). Hence, the registration rollers 16 are prevented from rotating when a paper P inserted through the manual feeding slot 20 is present on the conveying path.

In S240 the CPU 131 performs a process to drive the main motor 111 so that the agitator 86, supply roller 83, developing roller 84, photosensitive drum 71, heating roller 91, discharge rollers 94, and the like begin to rotate simultaneously. At this time, the paper supply solenoid 121 is off so that the pickup roller 14 and the feeding roller 12 do not rotate.

In S250 the CPU 131 enters a wait state until determining that a preset prescribed time T2 (six seconds, for example) has elapsed after initiating driving of the main motor 111. When the prescribed time T2 has elapsed (S250: YES), then in S320 the CPU 131 performs a process to halt the main motor 111 and subsequently ends the initialization process. Hence, in the initialization operation, the main motor 111 is driven for the prescribed time T2.

However, if the CPU 131 determines in S220 that the value of the flag f is "0" (S220: YES), then the CPU 131 performs a process to turn oft the registration solenoid 122 (setting the registration solenoid 122 to the transmission state in which the rotational driving force is transmitted from the main motor 111 to the registration rollers 16). In other words, when a paper P inserted through the manual feeding slot 20 does not exist on a conveying path, the registration rollers 16 can be rotated.

In S270 the CPU 131 performs a process for driving the main motor 111 so that the registration rollers 16, agitator 86, supply roller 83, developing roller 84, photosensitive drum 71, heating roller 91, discharge rollers 94, and the like begin rotating altogether. At this time, the paper supply solenoid 121 is off so that the pickup roller 14 and the feeding roller 12 do not rotate.

In S280 the CPU 131 determines whether the trailing edge sensor 31 has detected the paper P. If the CPU 131 determines in S280 that the trailing edge sensor 31 has not detected the paper P(S280: NO), then in S290 the CPU 131 determines whether the pre-registration sensor 32 has detected the paper P.

If the CPU 131 determines in S290 that the pre-registration sensor 32 has detected the paper P(S290; YES), then in S300 the CPU 131 performs a process for executing the manual intake operation. In other words, when the trailing edge sensor 31 has not detected the paper P but the pre-registration sensor 32 has detected the paper P, the CPU 131 determines that the paper P has been inserted through the manual feeding slot 20 and executes the manual intake operation. More specifically, the CPU 131 temporarily halts rotation of the registration rollers 16 when the pre-registration sensor 32 has detected the paper P (turns on the registration solenoid 122). Subsequently, the CPU 131 rotates the registration rollers 16 for a short prescribed time T2 until the leading edge of the paper P is interposed between the registration rollers 16. After the prescribed time T2 has elapsed, the CPU 131 again halts rotation of the registration rollers 16 (turns on the registration solenoid 122). Through this operation, the laser printer 1 of the present invention can prevent the paper P inserted through the manual feeding slot 20 from being immediately conveyed and discharged onto the discharge tray 4. Subsequently, the CPU 131 advances to S250 and performs the process described above.

However, if the CPU 131 determines in S290 that the pre-registration sensor 32 has not detected the paper P (hence, neither the trailing edge sensor 31 nor the pre-registration sensor 32 has detected the paper P; S290: NO), then in S310 the CPU 131 determines whether the prescribed time T2 has elapsed since initiating driving of the main motor 111.

If the CPU 131 determines in S310 that the prescribed time T2 has not elapsed (S310: NO), then the CPU 131 returns to S280. However, if the CPU 131 determines that the prescribed time T2 has elapsed (S310: YES), then in S320 the CPU 131 halts the main motor 111. Hence, in the initialization operation, the main motor 111 is driven for the prescribed time T2.

Further, if the CPU 131 determines in S280 that the trailing edge sensor 31 has detected the paper P, then the CPU 131 skips the process of S290 and advances to S310. In other words, when the trailing edge sensor 31 has detected the paper P, the CPU 131 continues rotating the main motor 111 regardless of whether the pre-registration sensor 32 has detected the paper P. Specifically, if the trailing edge sensor 31 has detected the paper P, it is conceivable that the paper supply solenoid 121 was turned on by some vibration or other reason, causing the paper P accommodated in the paper tray 11 to be fed (the paper P was not inserted via the manual feeding slot 20). Since the paper P should be removed from the conveying path, the paper P is immediately conveyed and discharged onto the discharge tray 4.

In the above-described process, S230, S260, S280 through 300 function as a removing unit for determining, when the image-forming unit 40 is not performing an operation for forming images on a paper P, whether a paper P exists on the conveying path that should be removed from the conveying path based on the detection results provided by the detecting unit, and performs a paper removal process for removing the paper P from the conveying path upon determining the existence of a paper to be removed from the conveying path. The removing unit determines whether the paper P is the one that has been inserted through the manual feeding slot 20, and when the removing unit determines that the paper P has been inserted through the manual feeding slot 20, the removing unit determines that the paper P need not be removed from the conveying path and, does not perform the recording medium removal process.

Next, the operations of the paper supply solenoid 121 and registration solenoid 122 in the printing process of the laser printer 1 will be described with reference to the timing chart of FIG. 6. At the beginning of a printing operation, the main motor 111 is driven. In the laser printer 1 of the preferred embodiment, the rotational speed of the main motor 111 is increased in stages.

Next, the paper supply solenoid 121 is turned on for a prescribed short time T3. Turning the paper supply solenoid 121 on causes the pickup roller 14 and feeding roller 12 to rotate and feed one sheet of the paper P accommodated in the paper tray 11. The sheet of paper P supplied at this time will be called the paper P1 for clarification.

As the paper P1 is conveyed by the rotation of the feeding roller 12, the trailing edge sensor 31 detects the paper P1 and, a short interval thereafter, the pre-registration sensor 32 detects the paper P1. When the pre-registration sensor 32 detects the paper P1, the registration solenoid 122 is turned on for a prescribed time T4, temporarily halting the rotation of the registration rollers 16. This is performed to correct the registration of the paper P1.

As the paper P1 is conveyed farther, the post-registration sensor 33 detects the paper P1. Subsequently, when the trailing edge sensor 31 detects the trailing edge of the paper P1, a prescribed time T5 after this detection time the paper supply solenoid 121 is turned on for a prescribed time T3. Turning on the paper supply solenoid 121 causes the pickup roller 14 and feeding roller 12 to rotate and feed a sheet of the paper P accommodated in the paper tray 11. This sheet of paper P will be referred to as a paper P2 for clarification.

The timing at which the second paper P2 is fed is determined based on the timing at which the trailing edge sensor 31 detected the trailing edge of the paper P1. By gauging the timing for feeding the next paper P based on the timing at which the trailing edge sensor 31 disposed near the paper tray 11 detects the trailing edge of the previous paper P, it is possible to reduce the distance between sheets of paper P supplied consecutively and, hence, to reduce the time required for printing a plurality of sheets of paper P.

When a prescribed time T6 has elapsed after the trailing edge sensor 31 detected the trailing edge of the paper P1, the registration solenoid 122 is turned on for a fixed time T7. Hence, after the prescribed time T6 from the time that the trailing edge sensor 31 detects the trailing edge of the paper P1, the rotation of the registration rollers 16 is halted for the fixed time T7. The prescribed time T6 is set to a value such that the rotation of the registration rollers 16 is halted after the paper P1 passes through the registration rollers 16 and before the paper P1 passes the post-registration sensor 33. Accordingly, the paper P1 is unaffected by the halting of the registration rollers 16 and is conveyed and discharged after being detected by the discharge sensor 34.

In the meantime, the paper P2 supplied from the paper tray 11 is conveyed by the rotation of the feeding roller 12, detected by the trailing edge sensor 31, and shortly thereafter detected by the pre-registration sensor 32. The fixed time T7 during which the rotation of the registration rollers 16 is halted is set to a value such that the registration rollers 16 begin rotating the prescribed time T4 after the pre-registration sensor 32 has detected the paper P2. The registration of the paper P2 is corrected according to a similar process to that described above for the paper P1.

If a paper P is inserted through the manual feeding slot 20 (hereinafter referred to as a "paper P3" for clarification) while the registration rollers 16 are conveying the paper P2, the paper P3 might be conveyed along with the paper P2 as the registration rollers 16 continue to rotate. However, as described above, after the prescribed time T6 has elapsed from the point that the trailing edge sensor 31 detected the trailing edge of the paper P2, the rotation of the registration rollers 16 is halted for a fixed time T7. Accordingly, the paper P2 passes through the registration rollers 16, but the paper P3 stops when the rotation of the registration rollers 16 is halted. As a result, the paper P2 separates from the paper P3, preventing the paper P3 from interfering with the process of printing an image on the paper P2. Further, since the prescribed time T6 has been set to halt the rotation of the registration rollers 16 before the trailing edge of the paper P2 passes the post-registration sensor 33, the paper P3 can be stopped before the leading edge of the paper P3 is detected by the post-registration sensor 33, even when the paper P3 is inserted immediately after the paper P2. Hence, the paper P3 is stopped in a state from which a normal printing operation can be performed.

The laser printer 1 of the preferred embodiment described above performs a removal process to remove the paper P (the process to display a paper jam error in S130 or the process to discharge the paper P in S270) prior to performing the initialization operation when the power is turned on or when the laser printer 1 has recovered from a sleep state, and upon determining in the initialization operation that a paper P to be removed exists on the conveying path (S120: YES, S150: YES, S170: YES, S280: YES). However, the laser printer 1 determines that the paper P need not be removed from the conveying path and does not perform the removal process upon determining that the paper P has been inserted through the manual feeding slot 20 based on results of detections by the trailing edge sensor 31. Hence, the laser printer 1 of the preferred embodiment can prevent the removal process from being performed unnecessarily on paper P that has been inserted normally through the manual feeding slot 20. For example, even though the presence of a paper P may be detected on the conveying path when the power source of the laser printer 1 is turned on, it is conceivable that a paper P supplied from the paper tray 11 stopped on the conveying path due to some aberration or that the paper P was inserted normally through the manual feeding slot 20. If the removal process were performed unconditionally on all paper P present on the conveying path during such a time, even the paper P inserted normally through the manual feeding slot 20 would be subjected to the removal process, making the laser printer 1 less user-friendly. To overcome this problem, the laser printer 1 employs the trailing edge sensor 31 to determine whether the paper P in the conveying path was inserted through the manual feeding slot 20. Accordingly, the laser printer 1 of the present invention can prevent the removal process from being performed unnecessarily.

Since the laser printer 1 of the preferred embodiment determines whether a paper P to be removed is present on the conveying path and performs the removal process when in a state that a paper P to be removed may be present on the conveying path, that is, when awakening from a rest state (a power off state or a sleep state) in which the laser printer 1 cannot detect the presence of the paper P on the conveying path or when driving the main motor 111 (during an initialization operation), the laser printer 1 can perform the removal process efficiently.

Further, since the laser printer 1 uses the trailing edge sensor 31, which is also used to gauge the timing for feeding the paper P from the paper tray 11, to determine whether the paper P1 was inserted through the manual feeding slot 20, the costs of the laser printer 1 can be reduced.

In the laser printer 1 of the preferred embodiment, the paper P detected only by the trailing edge sensor 31 has been supplied from the paper tray 11. Although the paper P may be present on the conveying path due to some aberration, the paper P has only been conveyed a short distance from the paper tray 11 and can likely undergo normal image formation. Accordingly, the laser printer 1 does not perform the removal process in this case, thereby preventing the removal process from being performed when normal image formation is possible.

Figure 6:
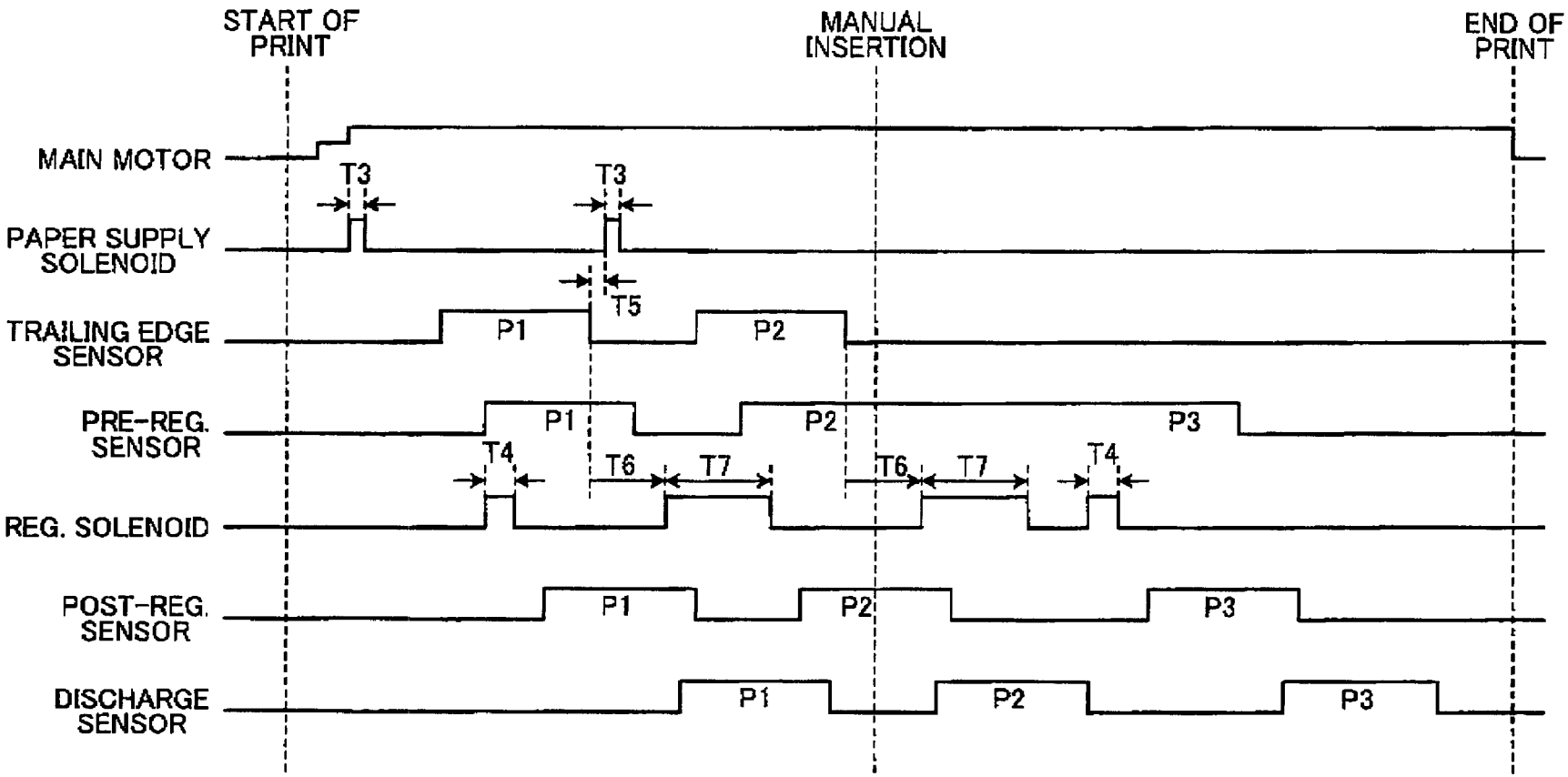
FIG. 6 is a timing chart illustrating the operations of a paper supply solenoid and a registration solenoid during a printing operation.

The laser printer 1 of the preferred embodiment halts rotation of the registration rollers 16 the prescribed time T6 after the trailing edge sensor 31 has detected the trailing edge of the paper P, so that the trailing edge of the paper P passes through the registration rollers 16 but does not pass the post-registration sensor 33 (FIG. 6). Hence, the laser printer 1 having this construction reduces the likelihood of a paper P inserted through the manual feeding slot 20 from being conveyed along with a paper P conveyed from the paper tray 11. In other words, if a paper P is inserted through the manual feeding slot 20 while another paper P is being conveyed from the paper tray 11, the paper P inserted through the manual feeding slot 20 may be conveyed along with the rotation of the registration rollers 16. However, the laser printer 1 of the preferred embodiment halts the rotation of the registration rollers 16 after the trailing edge of the paper P supplied from the paper tray 11 has passed through the registration rollers 16. As a result, the paper P inserted through the manual feeding slot 20 is no longer conveyed when the rotation of the registration rollers 16 is halted, enabling the paper P supplied from the paper tray 11 to separate from the paper P inserted through the manual feeding slot 20. Particularly, by using the trailing edge sensor 31 for detecting only the paper P supplied from the paper tray 11, the laser printer 1 can gauge the timing for halting rotation of the registration rollers 16, enabling the timing to be accurately gauged without the presence of the paper P inserted through manual feeding slot 20.

While the invention has been described in detail with reference to specific embodiments thereof, it would be apparent to those skilled in the art that many modifications and variations may be made therein without departing from the spirit of the invention, the scope of which is defined by the attached claims.

For example, although the laser printer 1 of the preferred embodiment described above performs a process (S130) to display a paper jam error when a paper P to be removed has been detected on the conveying path prior to the initialization operation, a process may be performed to discharge the paper P instead. However, since the paper P present on the conveying path when the power is turned on or when the laser printer 1 recovers from a sleep state may be there as a result of a paper jam, it is preferable to perform the process to display a paper jam error in order to ensure that the paper P is removed reliably.

Although the laser printer 1 of the preferred embodiment described above performs a process to discharge a paper P to be removed that has been detected on the conveying path during the initialization operation, a process to display a paper jam error or the like may also be performed. However, since the paper P detected during the initialization operation was likely conveyed from the paper tray 11 due to an aberration of the paper supply solenoid 121, normally the paper P can be discharged with no problem. Therefore, the discharge process is more advantageous because the paper P can be removed without inconveniencing the user.

Further, although the laser printer 1 of the preferred embodiment described above does not perform the removal process for a paper P that has been detected only by the trailing edge sensor 31, the removal process may also be used in this case. However, since such a paper P has only been conveyed a short distance from the paper tray 11 and can likely undergo a normal printing operation, it is preferable not to perform the removal process so as not to inconvenience the user.

Further, while the laser printer 1 of the preferred embodiment described above determines whether the paper P has been inserted through the manual feeding slot 20 based on the results of detections by the trailing edge sensor 31, the present invention is not limited to this configuration. For example, the laser printer 1 may be provided with a sensor for detecting only the paper P inserted via the manual feeding slot 20 and may determine whether the paper P was inserted via the manual feeding slot 20 based on the detection results from this sensor. Further, the history of detection results from the sensors 31-34 may be stored in memory, and the laser printer 1 may determine whether the paper P present on the conveying path when the power is turned on or when the laser printer 1 has recovered from a sleep state is a paper P that has been inserted through the manual feeding slot 20 based on this stored history. This determination may also be performed based on a user operation, for example.

In addition to a laser printer, the present invention may also be applied to an inkjet printer or other image-forming devices.

What is claimed is:

1. An image-forming device comprising:

an image-forming unit that forms images on a recording medium;

a recording medium accommodating unit that accommodates recording media to be supplied to the image-forming unit;

a detecting unit comprising at least one sensor that detects an existence of a recording medium on a conveying path along which the recording medium is conveyed from the recording medium accommodating unit to the image-forming unit and provides detection results indicative of whether the recording medium exists on the conveying path;

a removing unit that determines, when the image-forming unit is not performing an operation for forming images on a recording medium, whether a recording medium exists on the conveying path that should be removed from the conveying path based on the detection results provided by the detecting unit, and performs a recording medium removal process for removing the recording medium from the conveying path upon determining the existence of a recording medium to be removed from the conveying path; and a manual feeding slot through which a recording medium can be directly inserted onto the conveying path, wherein the removing unit determines whether the recording medium detected by the detecting unit is a recording medium that has been inserted through the manual feeding slot, and when the removing unit determines that the recording medium has been inserted through the manual feeding slot, the removing unit determines that the recording medium need not be removed from the conveying path and, does not perform the recording medium removal process.

2. The image-forming device according to claim 1, wherein the removing unit performs the recording medium removal process upon determining the existence of a recording medium to be removed from the conveying path based on the detection results provided by the detecting unit when the image-forming device is powered.

3. The image-forming device according to claim 1 selectively placed in a normal state that consumes a power and a sleep state that consumes less power than the normal state, wherein the removing unit performs the recording medium removal process upon determining the existence of a recording medium to be removed from the conveying path based on the detection results provided by the detecting unit when the sleep state is switched to the normal state.

4. The image-forming device according to claim 1, further comprising:

a plurality of rollers including a recording medium supply roller, the recording medium supply roller supplying the recording medium accommodated in the recording medium accommodating unit onto the conveying path;

a rotational driving force generating unit that generates a common rotational driving force for rotating the plurality of rollers; and a transmission state switching unit that switches between a transmission state that transfers the rotational driving force generated by the rotational driving force generating unit to the recording medium supply roller and a non-transmission state for not transferring the rotational driving force to the recording medium supply roller, wherein the removing unit performs the recording medium removal process upon determining the existence of a recording medium to be removed from the conveying path based on the detection results provided by the detecting unit during an initialization operation for setting the state of the transmission state switching unit to the non-transmission state and directing the rotational driving force generating unit to generate the rotational driving force.

5. The image-forming device according to claim 4, wherein a rotational driving force generating unit comprises a motor generating a rotational driving force, and the transmission state switching unit comprises a solenoid selectively rendered ON and OFF to selectively transmit the rotational driving force to the recording medium supply roller.

6. The image-forming device according to claim 1, wherein the removing unit performs a process to convey and discharge the recording medium to be removed from the conveying path as the recording medium removal process.

7. The image-forming device according to claim 1, further comprising a reporting unit that performs a reporting operation, wherein the removing unit executes a process using the reporting unit to prompt the user to remove the recording medium from the conveying path.

8. The image-forming device according to claim 7, wherein the reporting unit comprises a display.

9. The image-forming device according to claim 1, wherein the detecting unit comprises a dedicated sensor that detects recording medium supplied from the recording medium accommodating unit, the dedicated sensor providing a detection output, and the removing unit determines whether the recording medium detected by the detecting unit has been inserted through the manual feeding slot based on the detection output provided by the dedicated sensor.

10. The image-forming device according to claim 9, wherein the dedicated sensor detects only a recording medium supplied from the recording medium accommodating unit.

11. The image-forming device according to claim 10, wherein the dedicated sensor is disposed at a position on the conveying path upstream of a position for inserting a recording medium through the manual feeding slot.

12. The image-forming device according to claim 10, wherein the removing unit determines that the recording medium is not a recording medium that has been inserted through the manual feeding slot in response to the detection output.

13. The image-forming device according to claim 12, further comprising a pair of registration rollers that corrects an oblique orientation of the recording medium, the registration rollers being disposed on the conveying path downstream of the position for inserting the recording medium through the manual feeding slot, wherein the detecting unit further comprises a preregistration sensor that detects the existence of a recording medium on the upstream side of the registration rollers in order to gauge a timing at which the registration rollers correct an oblique orientation of the recording medium, and a timing sensor that detects the existence of a recording medium on the upstream side of the image-forming unit in order to gauge a timing at which the image-forming unit begins image formation, wherein the removing unit determines whether to perform the recording medium removal process in rules (1)-(4) based on outputs from the dedicated sensor, the pre-registration sensor, and the timing sensor:

(1) the removing unit determines that a recording medium detected by the timing sensor should be removed from the conveying path and performs the recording medium removal process;

(2) the removing unit determines that a recording medium detected by both the preregistration sensor and the dedicated sensor should be removed from the conveying path and performs the recording medium removal process;

(3) the removing unit determines that a recording medium detected by only the preregistration sensor and a recording medium detected by only the dedicated sensor should not be removed from the conveying path and does not perform the recording medium removal process; and (4) the removing unit does not perform the recording medium removal process when a recording medium has not been detected by anyone of the dedicated sensor, the pre-registration sensor, and the timing sensor.

14. The image-forming device according to claim 12, wherein the dedicated sensor detects the recording medium supplied from the recording medium accommodating unit at a position on the conveying path upstream of the position at which the recording medium is inserted through the manual feeding slot, detects the recording medium at a position near the recording medium accommodating unit, and is used for gauging the timing at which the recording medium accommodated in the recording medium accommodating unit is supplied onto the conveying path.

15. The image-forming device according to claim 14, wherein the detecting unit further comprises another sensor positioned downstream of the dedicated sensor on the conveying path, the removing unit determines that a recording medium should not be removed from the conveying path and does not perform the recording medium removal process if the another sensor has not detected the recording medium, even when the dedicated sensor has detected the recording medium.

16. The image-forming device according to claim 12, further comprising a pair of registration rollers that corrects an oblique orientation of the recording medium, the registration rollers being disposed on the conveying path downstream of the position at which the recording medium is inserted through the manual feeding slot, wherein the rotation of the registration rollers is halted a prescribed time after the dedicated sensor detects a trailing edge of the recording medium.

17. The image-forming device according to claim 16, wherein the detecting unit comprises a timing sensor that detects the existence of a recording medium upstream of the image forming unit in order to gauge the timing at which the image-forming unit begins image formation, and the timing for halting rotation of the registration rollers is set so that the trailing edge of the recording medium passes through the registration rollers but does not pass the timing sensor.

18. The image-forming device according to claim 17, wherein the removing unit determines that a recording medium detected by the timing sensor must be removed from the conveying path and performs the recording medium removal process.

19. The image-forming device according to claim 1, wherein the detecting unit comprises a timing sensor for detecting the existence of a recording medium upstream of the image forming nit in order to gauge the timing at which the image-forming unit begins image formation, and the removing unit determines that a recording medium detected by the timing sensor should be removed from the conveying path and performs the recording medium removal process.

* * * * *